US005078382A

United States Patent [19]

Tanjo et al.

[11] Patent Number: 5,078,382

[45] Date of Patent: Jan. 7, 1992

[54] PAPER FEEDER

[75] Inventors: Toru Tanjo, Toyonaka; Tsukasa Sugiyama, Moriguchi, both of Japan

[73] Assignee: Mita Industrial Co., Ltd., Osaka, Japan

[21] Appl. No.: 584,302

[22] Filed: Sep. 18, 1990

[30] Foreign Application Priority Data

Sep. 26, 1989 [JP] Japan ..... 1-251316

[51] Int. Cl.[5] ..... B65H 1/22

[52] U.S. Cl. ..... 271/164; 271/110; 271/117; 271/258; 221/153; 221/154; 292/201; 312/301

[58] Field of Search ..... 271/145, 162, 164, 110, 271/117, 258, 259, 241; 221/153, 154, 248; 292/201; 312/301

[56] References Cited

U.S. PATENT DOCUMENTS 4,165,069 8/1979 Colglazier et al. ..... 271/162
4,718,658 1/1988 Hirose et al. ..... 271/258
4,835,567 5/1989 Ogata ..... 271/164 X
4,958,823 9/1990 Iwaki et al. ..... 271/164 X

FOREIGN PATENT DOCUMENTS 59-207333 11/1984 Japan .
0167136 7/1987 Japan ..... 271/162
0098531 4/1989 Japan ..... 271/162

*Primary Examiner*—H. Grant Skaggs
*Assistant Examiner*—Carol Lynn Druzbick
*Attorney, Agent, or Firm*—Jordan and Hamburg

[57] ABSTRACT

A paper feeder having a feed unit for dispensing paper from a paper containing unit and delivering the paper to a transport assembly. The feeder comprises a first guide portion for guiding the paper containing unit and a second guide portion for guiding the feed unit. The paper containing unit and the feed unit are slidably supported by the first guide portion and the second guide portion respectively individually.

18 Claims, 3 Drawing Sheets

PAPER FEEDER

BACKGROUND OF THE INVENTION AND RELATED ART STATEMENT

The present invention relates to improvements in paper feeders for use in image forming apparatus such as electrostaticcopying machines and facsimile apparatus.

Paper feeders for use in image forming apparatus generally comprise a paper containing unit including a paper tray, and a feed unit having a feed roller for dispensing sheets of paper from the containing unit one by one. In recent years, the paper containing unit is made withdrawable in a direction perpendicular to the direction of transport of paper for the user to supply paper to the containing unit as withdrawn from the image forming apparatus forwardly thereof so as to reduce the space needed for the installation of the apparatus and facilitate the replenishment of paper. However, the paper feeder thus constructed has the following problem. When paper has jammed the feed unit, the paper containing unit is withdrawn to remove the jamming paper. The paper is then pulled sideways by the withdrawing movement and is liable to break to partly remain inside the apparatus. The remaining portion of the paper is cumbersome to remove.

As disclosed, for example, in Unexamined Japanese Patent Publication SHO 59-207333, paper feeders are already known which comprise a paper containing unit and a feed unit which are in the form of an assembly so as to be withdrawn at the same time, such that in an event of a paper jam in the feed unit, the jamming paper is withdrawn from the image forming apparatus forwardly thereof along with the containing unit and the feed unit and can therefore be removed without breaking.

When the paper containing unit of the disclosed paper feeder is withdrawn from the image forming apparatus forwardly thereof for the replenishment of paper, the feed unit having a feed roller is withdrawn as connected to the containing unit. Accordingly, the feeder has the problem that the feed unit becomes an obstacle to the replenishment of paper.

Further Unexamined Japanese Patent Publication SHO 63-212629 discloses a paper feeder which comprises a feed unit, a paper containing unit withdrawable together with the feed unit, and a guide portion for pivotally shifting the feed unit with the withdrawing movement to position the feed roller away from the paper containing unit when the feeder is withdrawn and to thereby facilitate the replenishment of paper. With this arrangement, the feed roller is still positioned above the paper containing unit, which therefore can not be replenished with paper with greatly increased ease. Moreover, when the paper containing unit is withdrawn for replenishment, the feed unit is also withdrawn therewith at all times, so that every time the containing unit is withdrawn, the feed roller must be uncoupled from the drive mechanism therefor and thereafter coupled thereto again. This procedure is cumbersome and further involves the problem that the gear or the like constituting the drive mechanism is prone to damage or break when the roller is coupled thereto.

SUMMARY OF THE INVENTION

An object of the present invention is to provide a paper feeder for use in image forming apparatus which comprises a feed unit and a paper containing unit adapted to be replenished with paper easily without being interfered with by the feed unit and from which jamming paper can be readily removed in the event of a paper jam.

The present invention provides a paper feeder having a feed unit for dispensing paper from a paper containing unit and delivering the paper to a transport assembly, the paper feeder comprising a first guide portion for guiding the paper containing unit and a second guide portion for guiding the feed unit, the paper containing unit and the feed unit being slidably supported by the first guide portion and the second guide portion respectively individually.

According to the present invention, the paper containing unit and the feed unit are supported individually withdrawably from an image forming apparatus, so that the paper containing unit can be singly withdrawn from the apparatus forwardly thereof and replenished with paper free of interference by the feed unit In the event of a jam, both the paper containing unit and the feed unit are withdrawn for the removal of the jamming paper. Since the feed unit need not be withdrawn for the replenishment of paper, there is no need to follow the cumbersome procedure of uncoupling the feed roller or the like of the feed unit from the drive mechanism therefor every time when the containing unit is to be replenished. This renders the feeder easier to handle and prevents the drive mechanism, etc. from damage or break.

These and other objects, features and advantages of the present invention will become more apparent upon a reading of the following detailed description and drawings.

DESCRIPTION OF THE PREFERRED EMBODIMENTS

Figure 1:
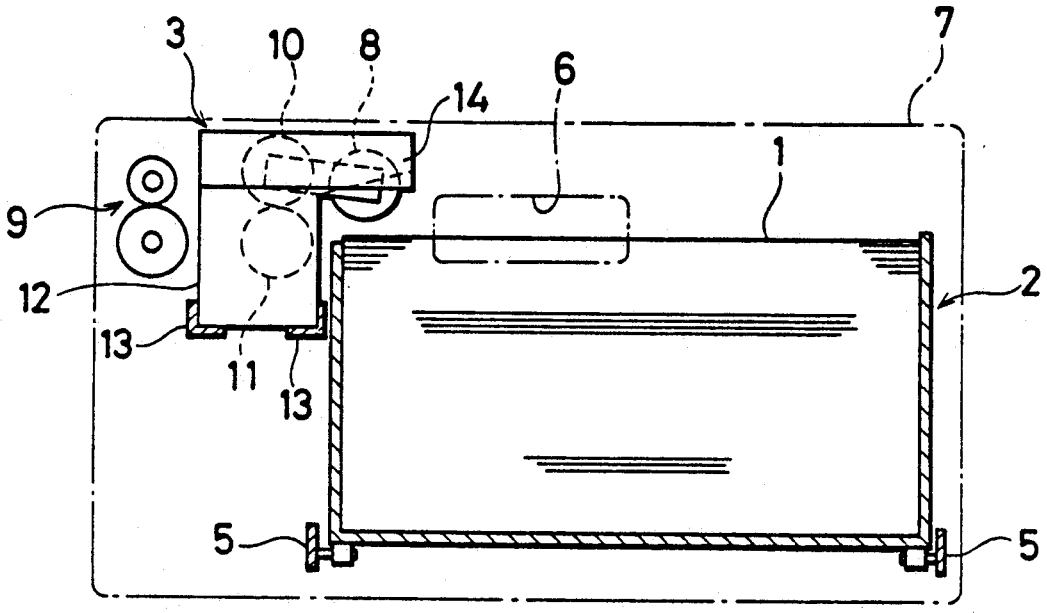
FIG. 1 is a front view in section showing a paper feeder as a first embodiment of the invention.
Figure 2:
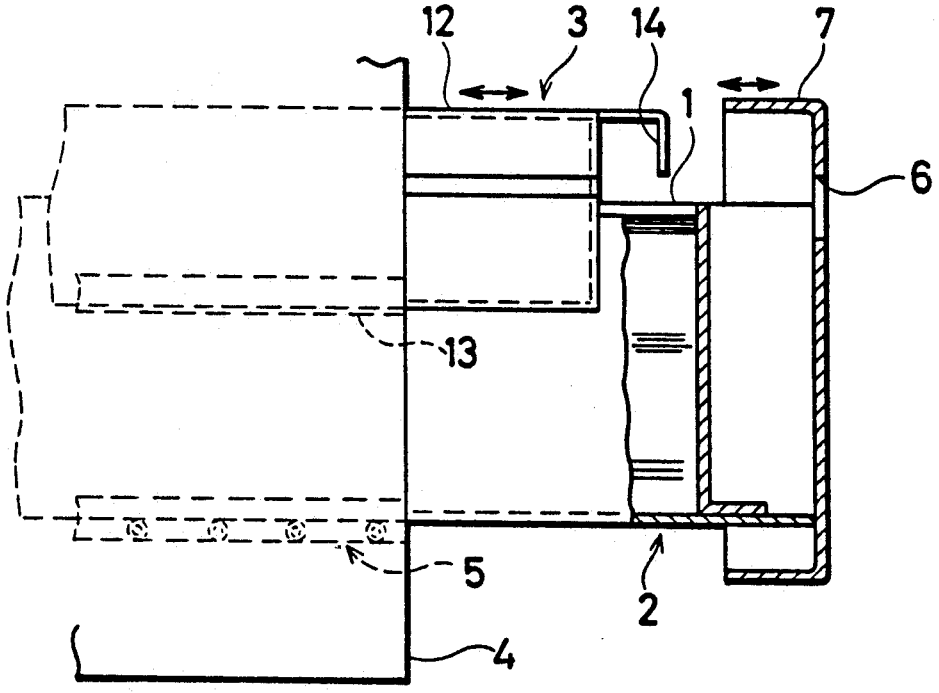
FIG. 2 is a side elevation partly broken away and showing the paper feeder.

FIGS. 1 and 2 show a paper feeder as a first embodiment of the present invention. The paper feeder comprises a paper containing unit 2 comprising a tray for accommodating paper 1 cut in a predetermined size, and a feed unit 3 for dispensing the paper one sheet after another from the containing unit 2. The paper containing unit 2 is supported by a first guide portion 5 comprising guide rails attached to the body 4 of an image forming apparatus, such as an electrostatic copying machine, and is withdrawable in a direction perpendicular to the direction of transport of the paper 1. A cover 7 is attached to the front side of the paper containing unit 2 and has an opening 6 providing a handle portion for withdrawing the unit 2. The front side of the portion where the feed unit 3 is provided is covered with the cover 7.

The feed unit 3 comprises a feed roller 8 held in pressing contact with the upper surface of the paper 1 within the containing unit 2 by unillustrated biasing means and drivingly rotatable by a drive unit provided in a rear portion of the apparatus body 4, and a pair of upper and lower separating rollers 10, 11 for separating sheets of paper 1 one by one as dispensed by the feed roller 8 and delivering the sheet to a transport assembly comprising a transport roller 9, etc. The feed roller 8 and the separating rollers 10, 11 are rotatably supported by a frame 12 and thereby assembled into the unit 3. The frame 12 is slidably supported by a second guide portion 13 comprising L-section steel members attached to the apparatus body 4. When the frame 12 is slidingly moved by the hand gripping a drawing handle 14 projecting from the front side of the frame 12, the feed unit 3 can be withdrawn in parallel to the direction of withdrawal of the paper containing unit 2.

When the containing unit 2 is to be replenished with paper 1, the cover 7 is pulled toward the user with the hand inserted into the opening 6 of the cover 7 and gripping the cover upper portion, whereby the containing unit 2 is withdrawn from the apparatus body 4 along the first guide portion 5 forwardly of the apparatus. The unit 2 is then replenished with paper 1 from above.

In this way, the paper containing unit 2 and the feed unit 3 are respectively supported by the first guide portion 5 and the second guide portion 13 individually withdrawably, so that the paper containing unit 2 can be singly withdrawn from the apparatus body 4 forwardly thereof for replenishment. Accordingly, the containing unit 2 can be replenished with paper 1 easily without being interfered with by the feed unit 3. Moreover, every time the containing unit 2 is replenished with paper 1, the feed roller 8 and the separating rollers 10, 11 of the feed unit 3 need not be uncoupled from and coupled again to the drive mechanism therefor, whereas such a cumbersome procedure is required for the conventional feeder wherein the feed unit is withdrawn along with the containing unit to be replenished with paper. This renders the feeder easier to handle and effectively prevents the drive mechanism from damage or break that would result from the uncoupling and coupling procedure.

Further when the paper 1 dispensed from the paper containing unit 2 has jammed the feed unit 3, the containing unit 2 is withdrawn along the first guide portion 5, and the feed unit 3 is withdrawn forward from the body 4 of the image forming apparatus along the second guide portion 13 with the hand holding the handle 14 of the frame 12. This makes it easy to remove the jamming paper. In the case where the cover 7 of the paper containing unit 2 is adapted to cover the front side of the portion where the feed unit 3 is installed as stated above, the feed unit 3 is automatically locked if the containing unit 2 is locked against withdrawal. This results in the advantage that there is no need to provide a locking mechanism specifically for the fee unit 3 for preventing this unit from withdrawal, hence a simplified construction.

Figure 3:
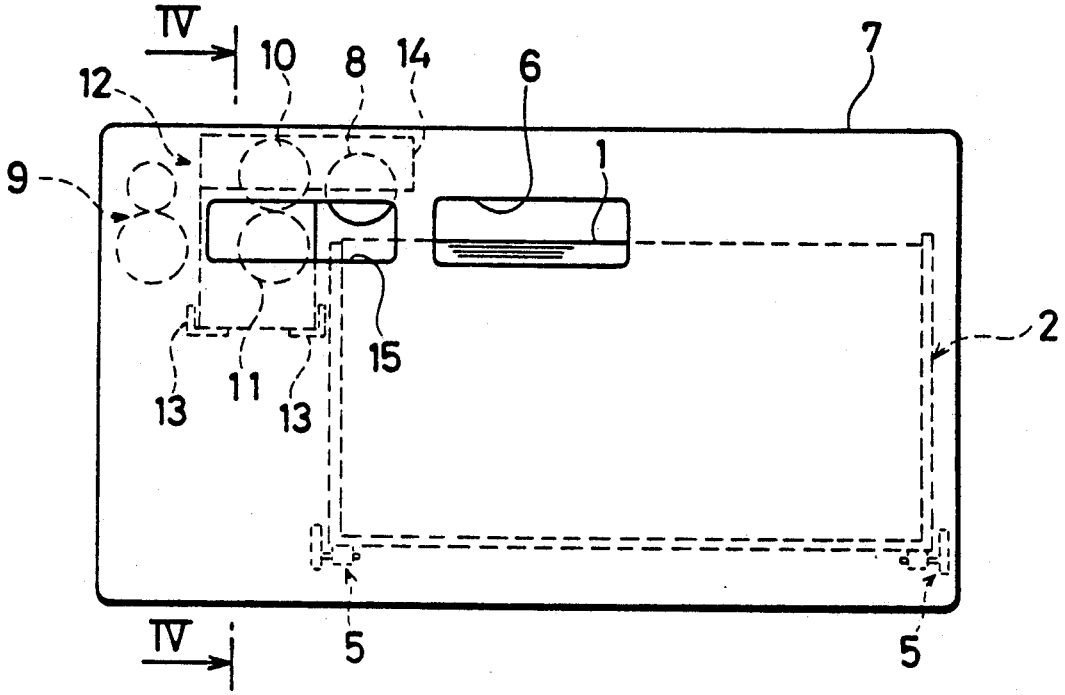
FIG. 3 is a front view showing another paper feeder as a second embodiment of the invention.
Figure 4:
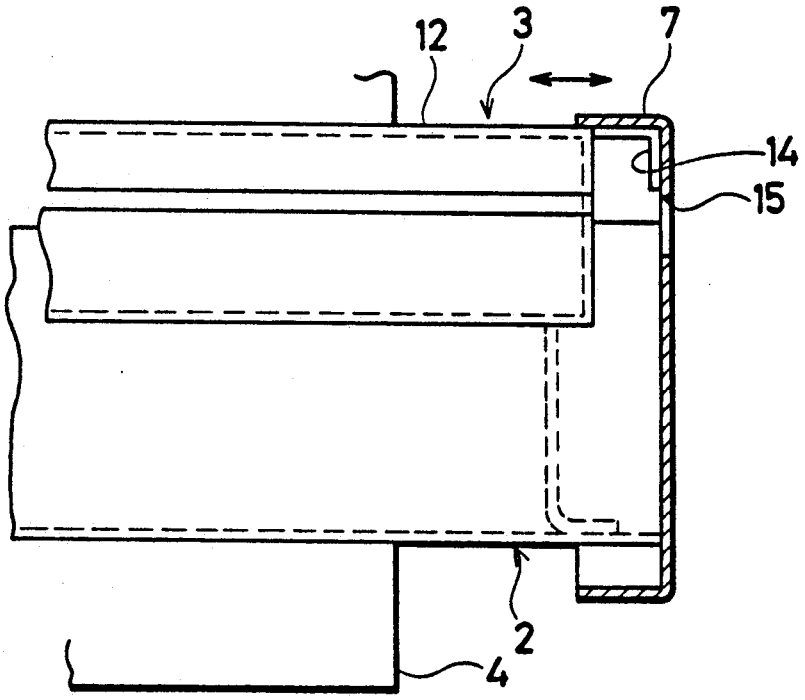
FIG. 4 is a view in section taken along the line IV—IV in FIG. 3.

FIGS. 3 and 4 show another paper feeder as a second embodiment of the present invention. This embodiment has the same construction as the first embodiment except that at one side of a first handle portion provided by the above opening 6 formed in the cover 7 of the paper containing unit 2 for withdrawing the containing unit 2, the cover 7 has an opening 15 providing a second handle portion for withdrawing the paper containing unit 2 and the feed unit 3 together. More specifically, the opening 15 is formed below the position of the handle 14 for withdrawing the feed unit 3. The paper containing unit 2 and the feed unit 3 can be withdrawn at the same time along the first guide portion 5 and the second guide portion 13, respectively, by inserting the hand into the opening 15 and pulling the openingdefining cover upper portion and the handle 14 grasped by the hand.

Thus, the paper containing unit 2 and the feed unit 3 are made withdrawable at the same time by the second handle portion which is provided by the opening 15 formed in the cover 7 and by the handle 14 projecting from the frame 12. In the event of a jam occurring in this case, the paper containing unit 2 and the feed unit can be withdrawn together along the first and second guide portions 5, 13 along with the jamming paper, with the result that the paper can be removed easily without breaking.

Figure 5:
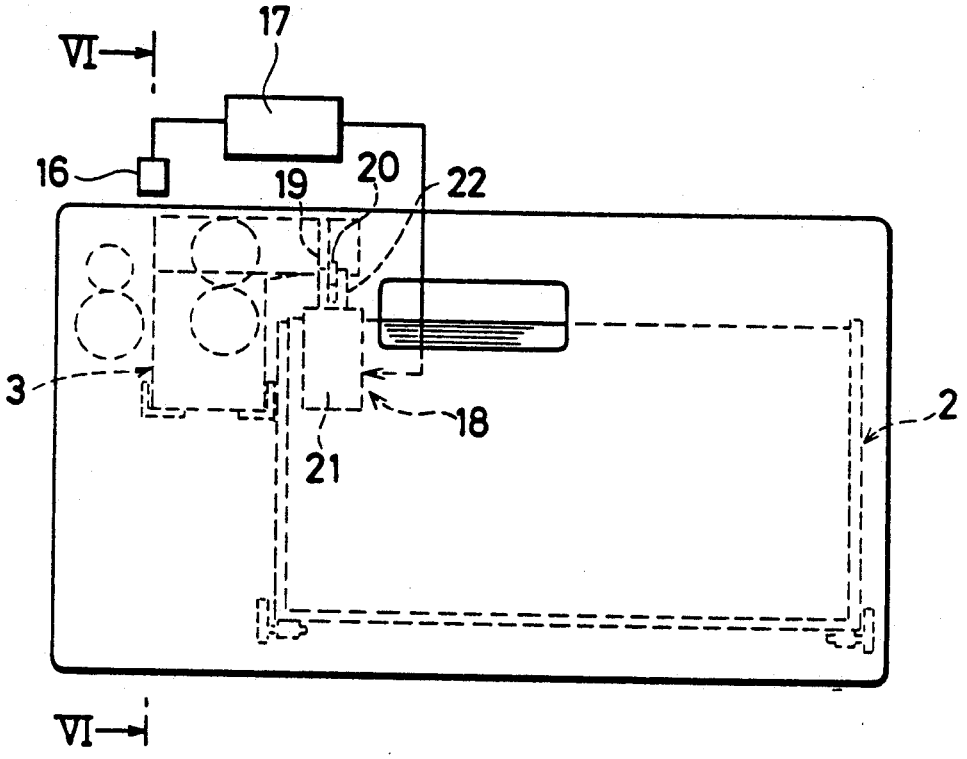
FIG. 5 is a front view showing another paper feeder as a third embodiment of the invention.
Figure 6:
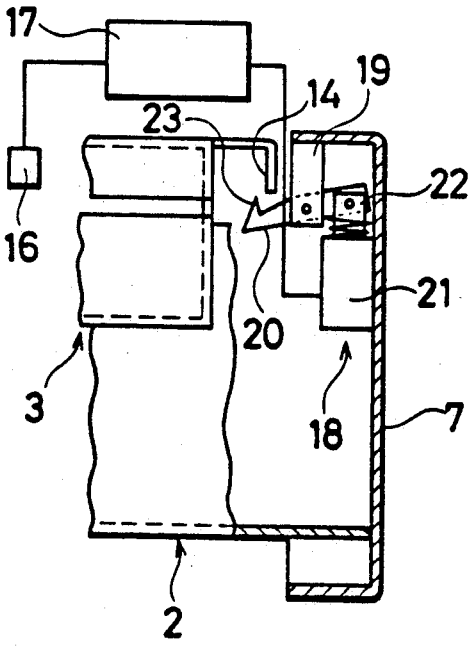
FIG. 6 is a view in section taken along the line VI—VI in FIG. 5.
Figure 7:
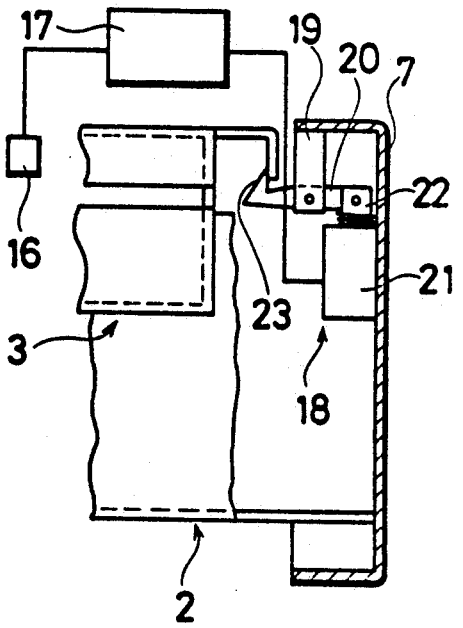
FIG. 7 is a view corresponding to FIG. 6 and showing a connecting member in operation.

FIGS. 5 to 7 show another paper feeder as a third embodiment of the present invention. This embodiment has the same construction as the first embodiment except that the paper feeder has sensor means 16 comprising a jam sensor for detecting a jam caused by the paper 1 dispensed from the paper containing unit 2, control means 17 for producing a control signal in response to a detection signal from the sensor means 16 in the event of a jam occurring,and a connecting member 18 for connecting the paper containing unit 2 and the feed unit 3 together in response to the control signal from the control means 17. The connecting member 18 comprises a lever 20 pivotally movably supported by a bracket 19 on the cover 17, and a latch solenoid 21 for driving the lever 20. In response to the control signal delivered from the control means 17, the rod 22 of the latch solenoid 21 is lowered and retained in the lowered position as seen in FIG. 7 under the action of a spring, raising the forward end of the lever 20. This state is maintained until a control signal is produced next. With the rise of the forward end of the lever 20, a hook 23 engages the handle 14 of the feed unit 3, whereby the cover 7 of the containing unit 2 and the handle 14 of the feed unit 3 are connected together.

In the usual state free of any jam, the rod 22 of the latch solenoid 21 is held in a raised position as seen in FIG. 6 with the hook 23 of the lever 20 held away from the handle 14 of the feed unit 3. The paper containing unit 2 alone can therefore be withdrawn for replenishment with paper 1.

In the case where the connecting member 18 for connecting the cover 7 of the containing unit 2 t the handle 14 of the feed unit 3 is provided to connect the containing unit 2 and the feed unit 3 together by the member 18 in the event of a jam occurring, the feed unit 3 as jammed with paper 1 is invariably drawn out along with the containing unit 2 when the unit 2 is withdrawn by the hand gripping the cover 7. This reliably obviates the likelihood that the containing unit 2 only will be withdrawn despite the jam to break the jamming paper.

According to the third embodiment, the connecting member 18 is driven by the latch solenoid 21 which is so adapted that the rod 22, when lowered, is held in the lowered position until the next control signal is given.

This results in the advantage that when the paper containing unit 2 and the feed unit 3 are withdrawn from the apparatus body 4 in the event of a jam, the latch solenoid 21 need not be held energized, hence a simplified energizing circuit.

Although the connecting member 18 is provided on the cover 7 of the paper containing unit 2 according to the third embodiment, the connecting member may be provided on the frame 12 of the feed unit 3 and made engageable at its hook with an engaging portion of the cover 7 so as to connect the containing unit 2 and the feed unit 3 together.

Although the present invention has been fully described by way of example with reference to the accompanying drawings, it is to be understood that various changes and modifications will be apparent to those skilled in the art. Therefore, unless otherwise such changes and modifications depart from the scope of the invention, they should be construed as being included therein.

What is claimed is:

1. A paper feeding comprising:

a paper containing unit for containing paper therein;

a feed unit for dispensing paper from the paper containing unit and delivering the paper to a transport assembly;

a first guide portion for guiding the paper containing unit; and a second guide portion for guiding the feed unit;

the paper containing unit and the feed unit being individually supported by the respective first guide portion and the second guide portion slidably in a widthwise direction relative to the direction of feed of the feed unit.

2. A paper feeder as defined in claim 1, wherein the paper containing unit and the feed unit are shiftable between an operable position and a withdrawn position, and means on said paper containing unit are operable to preclude movement of said feed unit from said operable position to said withdrawn position when said paper containing unit is in said operable position.

3. A paper feeder as defined in claim 2 which further comprises a first handle portion for slidingly withdrawing the paper containing unit along the first guide portion, and a second handle portion for slidingly withdrawing the paper containing unit and the feed unit together along the first guide portion and the second guide portion, respectively.

4. A paper feeder as defined in claim 3, wherein said means comprises a cover, said first handle portion being provided by an opening formed in said cover attached to the paper containing unit, and the second handle portion is provided by an opening formed in the cover and by a handle projecting from a frame of the feed unit.

5. A paper feeder as defined in claim 1 which further comprises a first handle portion for slidingly withdrawing the paper containing unit along the first guide portion, and a second handle portion for slidingly withdrawing the paper containing unit and the feed unit together along the first guide portion and the second guide portion, respectively.

6. A paper feeder as defined in claim 5 wherein the first handle portion is provided by an opening formed in a cover attached to the paper containing unit, and the second handle portion is provided by an opening formed in the cover and by a handle projecting from a frame of the feed unit.

7. A paper feeder having a feed unit for dispensing paper from a paper containing unit and delivering the paper to a transport assembly, the paper feeder being characterized in that the feeder comprises a first guide portion for guiding the paper containing unit and a second guide portion for guiding the feed unit, the first guide portion and the second guide portion being arranged in parallel to each other, the paper containing unit and the feed unit being individually slidably supported by the first guide portion and the second guide portion respectively, sensor means for detecting a jam caused by the paper dispensed from the paper containing unit, and a connecting member for connecting the paper containing unit and the feed unit together upon detection of a jam by the sensor means.

8. A paper feeder as defined in claim 7 wherein the connecting member comprises a lever pivotally movably supported by a cover of the paper containing unit, and a latch solenoid for driving the lever.

9. A paper feeder as defined in claim 8 wherein said latch solenoid has a rod such that when the rod is lowered to lock the lever, the rod is held in the lowered position until a control signal is subsequently given.

10. A paper feeder as defined in claim 7 wherein the connecting member comprises a lever pivotally supported by a frame of the feed unit, and a latch solenoid for driving the lever.

11. A paper feeder having a feed unit for dispensing paper from a paper containing unit and delivering the paper to a transport assembly, the paper feeder being characterized in that the feeder comprises a first guide portion for guiding the paper containing unit and a second guide portion for guiding the feed unit, the paper containing unit and the feed unit being individually slidably supported by the first guide portion and the second guide portion, respectively, a first handle portion for slidingly withdrawing the paper containing unit along the first guide portion, and a second handle potion for slidingly withdrawing the paper containing unit and the feed unit together along the first guide portion and the second guide portion, respectively, the paper containing unit having a cover, said cover having opening means, the feeder unit having a frame, the first handle portion being provided by said opening means formed in said cover, the second handle portion being provided by said opening means formed in said cover and by a handle projecting from said frame of the feed unit.

12. A paper feeder comprising:

a paper unit containing paper;

a feed unit comprising roller means having an axis of rotation, said roller means feeding said paper from said paper unit in a direction perpendicular to said axis of rotation;

first guide means for moveably guiding said paper unit in a direction generally parallel to said axis of rotation; and second guide means for moveably guiding said feed unit in a direction generally parallel to said axis of rotation, said first guide means being operable to moveably guide said paper unit independently of the movement of the feed unit along said second guide means.

13. A paper feeder according to claim 12, wherein said paper unit is moveable along said first guide means between a paper unit operable position and a paper unit withdrawn position, said feed unit being moveable along said second guide means between a feed unit operable position and a feed unit withdrawn position, said paper unit being moveable from said paper unit operable position to said paper unit withdrawn position while said feed unit remains in said feed unit operable position.

14. A paper feeder according to claim 13, wherein said paper unit has a handle means having a first part graspable by an operator to move said paper unit from said paper unit operable position to said paper unit withdrawn position as said feed unit remains in said feed unit operable position, said handle means having another part graspable by an operator to move both said paper unit and feed unit together from their respective operable positions to their respective withdrawn positions.

15. A paper feeder according to claim 14, wherein said paper unit has a cover having a front, said first part of said handle means comprising an opening in said front of said cover.

16. A paper feeder according to claim 14, wherein said feed unit has a cover having a front and a frame part disposed juxtaposed to said front of said cover when said paper unit and feed unit are each in their respective operable positions, said second part of said handle means comprising an opening in said front of said cover which permits access of an operator to said frame part of said feed unit such that an operator can reach through said opening to engage said frame part and move both said paper unit and feed unit together from their respective operable positions to their respective withdrawn positions.

17. A paper feeder according to claim 12 further comprising lockable means on said paper unit and on said feed unit, said lockable means being operable between a locked position and an unlocked position, said lockable means when in said unlocked position permitting said paper unit to be moved from said paper unit operable position to said paper unit withdrawn position while said feed unit remains in said feed unit operable position, said lockable means when in said locked position locking said feed unit to said paper unit such that said paper unit and feed unit are moved together from their respective operable positions to their respective withdrawn positions.

18. A paper feeder according to claim 17, wherein said locking means comprises jam sensor means for sensing jams which occur as the paper is fed from said paper unit, said lockable means being operated from said unlocked position to said locked position when said jam sensor senses a jam occuring as the paper is fed from said paper unit.

* * * * *